US008858404B2

(12) United States Patent
Mathews

(10) Patent No.: US 8,858,404 B2
(45) Date of Patent: Oct. 14, 2014

(54) HAND-HELD EXERCISE WEIGHT

(71) Applicant: Ronald Mathews, Los Angeles, CA (US)

(72) Inventor: Ronald Mathews, Los Angeles, CA (US)

( * ) Notice: Subject to any disclaimer, the term of this patent is extended or adjusted under 35 U.S.C. 154(b) by 1 day.

(21) Appl. No.: 14/077,386

(22) Filed: Nov. 12, 2013

(65) Prior Publication Data

US 2014/0073494 A1 Mar. 13, 2014

Related U.S. Application Data

(63) Continuation of application No. 12/782,242, filed on May 18, 2010, now Pat. No. 8,608,628.

(51) Int. Cl.

| | |
|---|---|
| ***A63B 21/00*** | (2006.01) |
| ***A63B 21/072*** | (2006.01) |
| ***A63B 21/06*** | (2006.01) |
| ***A63B 21/075*** | (2006.01) |

(52) U.S. Cl.

CPC ..... *A63B 21/0728* (2013.01); *A63B 21/072* (2013.01); *A63B 21/0602* (2013.01); *A63B 21/075* (2013.01)

USPC ..... 482/104; 482/105; 482/107; 24/67.9; 24/198

(58) Field of Classification Search

USPC ..... 24/67.9, 198, 200; 482/104, 105, 106, 482/107, 108

See application file for complete search history.

(56) References Cited

U.S. PATENT DOCUMENTS

| | | | | |
|---|---|---|---|---|
| 764,719 | A * | 7/1904 | Gorton | 24/547 |
| 2,341,121 | A * | 2/1944 | Schaaff | 24/561 |
| 4,337,593 | A | 7/1982 | McAllister | |
| 5,674,162 | A * | 10/1997 | Ellingson et al. | 482/110 |
| D397,940 | S | 9/1998 | Safarian | |
| 6,730,004 | B2 | 5/2004 | Selsam | |
| 7,097,601 | B1 * | 8/2006 | Ronnow | 482/106 |
| 7,381,157 | B2 * | 6/2008 | Blateri | 482/50 |
| D586,042 | S * | 2/2009 | Tsai | D28/39 |

* cited by examiner

*Primary Examiner* — Jerome W Donnelly
(74) *Attorney, Agent, or Firm* — Posz Law Group, PLC

(57) ABSTRACT

An exercise weight includes a weight member, a handle member spaced apart from and substantially surrounding the weight member, and at least one attachment member joining the weight member to the handle member so that the weight member is located inside the handle member. The exercise weight has a relatively narrow profile, or width, to avoid contact with the body during exercise.

6 Claims, 19 Drawing Sheets

HAND-HELD EXERCISE WEIGHT

CROSS-REFERENCE TO RELATED APPLICATION

This application is a continuation of U.S. patent application Ser. No. 12/782,242, filed May 18, 2010, titled "HAND-HELD EXERCISE WEIGHT", which is incorporated herein by reference in its entirety.

BACKGROUND

The present invention relates to an exercise weight, and more particularly, to an exercise weight that includes a surrounding handle.

Conventional hand-held exercise weights pose a risk of contact with the body, especially the torso, arms, legs, and head when the weights are swung with the arms in a forward to backward motion relative to the body or up and down along the side or between the legs.

SUMMARY

Basically, the invention is an exercise weight including a weight member, a handle member spaced apart from and substantially surrounding the weight member, and at least one attachment member joining the weight member to the handle member.

In one aspect of the invention, the handle member is annular and can have the shape of a circle, oval, ellipse or polygon.

In another aspect of the invention, the weight member generally has the shape of a circular sphere, a flattened sphere, an ovoid sphere, an elliptical sphere, a teardrop shaped sphere, a torus, a three-dimensional multifaceted solid, a letter, a number, a design, an emblem, a symbol, a mark, or a word.

In another aspect of the invention, the center of gravity of the weight member is at the center of gravity of the exercise weight.

In another aspect of the invention, the handle member defines a plane, and the plane intersects the center of gravity of the weight member.

In another aspect of the invention, the weight member includes a space for containing a fluid and an opening for adding or removing the fluid.

In another aspect of the invention, the handle member, the weight member and the attachment arm are parts of a unitary, integral casting.

In another aspect of the invention, the weight ratio of the weight member and the attachment member to the exercise weight is between about 5 to about 95 percent.

In another aspect of the invention, the weight ratio of the handle member to the exercise weight is between about 5 to about 95 percent.

In another aspect of the invention, a coupling mechanism is located between the attachment member and the weight member or between the handle member and the attachment member.

In another aspect of the invention, the coupling mechanism includes one of a threaded engagement and a bayonet coupling.

BRIEF DESCRIPTION OF THE DRAWINGS

The accompanying figures, together with the detailed description below, are incorporated in and form part of the specification and serve to further illustrate various embodiments and to explain various principles and advantages all in accordance with the present invention.

DETAILED DESCRIPTION OF THE PREFERRED EMBODIMENTS

Figure 2:
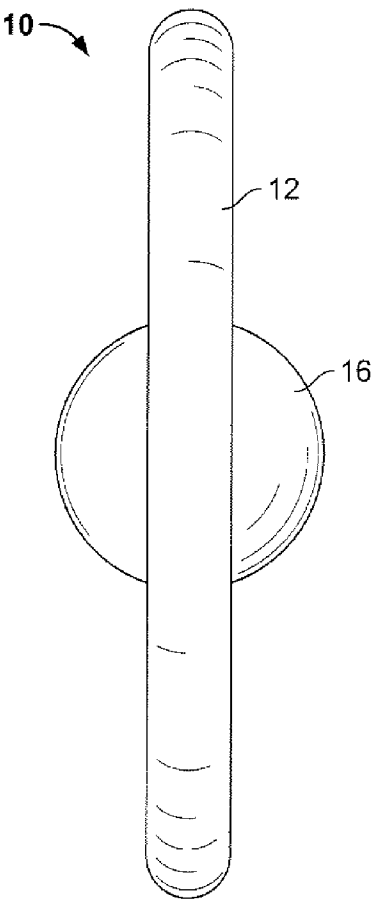
FIG. 2 illustrates a side view of the exercise weight illustrated in FIG. 1.
Figure 1:
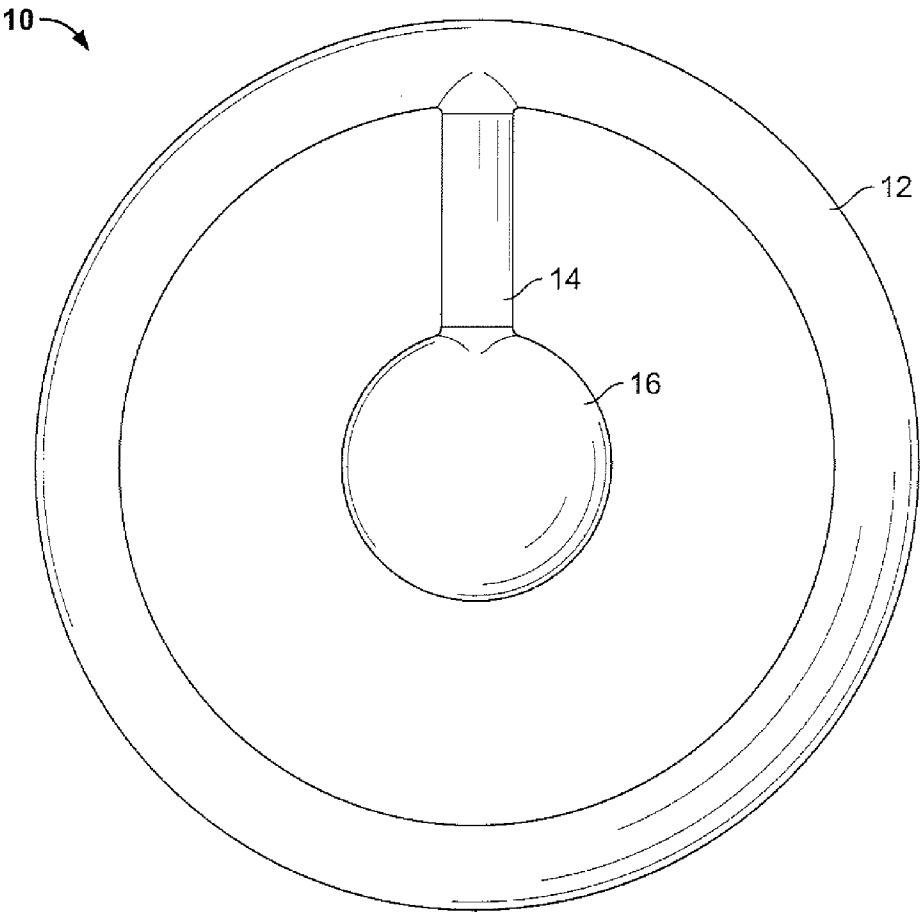
FIG. 1 illustrates a front view of a first embodiment of the hand-held exercise weight of the invention.

Referring to FIG. 1, a hand-held exercise weight 10 is illustrated. The exercise weight 10 includes a handle member, an attachment member 14, and a weight member 16. The handle member 12 is spaced apart from and substantially surrounds the weight member 16. An attachment member 14 joins the weight member 16 to the handle member 12 so that the weight member 16 is located inside the handle member.

The handle member 12 is circular in the embodiment of FIG. 1; however, the handle member 12 can be triangular, square, oval, or otherwise non-circular, which is apparent in the descriptions of further embodiments below. The handle is preferably annular and formed to lie in a plane. In other words, the axis passing through the center of any cross section taken of the handle member defines a plane, which is parallel to the plane of the sheet of FIG. 1.

In the embodiment of FIG. 1, the cross-sectional shape of the handle member 12 is circular and uniform; however, the cross-sectional shape can be elliptical or oval or various other shapes, as long as the handle member 12 is rounded and comfortable to grip. Further, the cross-sectional shape of the handle member 12 can vary along its length. Although not illustrated, the handle member 12 can be constructed to be collapsible or foldable.

The attachment member 14 extends radially between the weight member 16 and the handle member 12 and joins the weight member 16 to the handle member 12. The attachment member 14 preferably lies in the plane of the handle member 12. More specifically, the axis of the attachment member 14 lies in the plane defined by the axis of the handle member 12. The attachment member 14 has sufficient strength to secure the weight member 16 to the handle member 12 even if the exercise weight 10 is subjected to great shock such as that of being dropped on a hard surface during exercise.

In the embodiment of FIG. 1, the attachment member 14 has a uniform, round cross-section. However, the attachment member 14 can have a variable cross-section along its length. For example, the attachment member 14 can be rod-shaped, frusto-conical, globular, triangular, squared, pentagonal, hexagonal or irregular in shape.

The weight member 16 is fixed to an inner end of the attachment member 14. In the embodiment of FIG. 1, the weight member 16 is permanently fixed to the attachment member 14; however, the weight member 16 can be attached to the attachment member 14 with a coupling mechanism for rapidly removing and replacing the weight member 16 one of a different weight or configuration. Alternatively, a combination of the weight member 16 and the attachment member 14 can be attached with a coupling mechanism to the handle member 12. The weight member 16 has the shape of a circular sphere in the first embodiment of FIG. 1; however, the weight member 16 can have many different shapes as described in connection with further embodiments below, and the weight member 16 can be solid or hollow.

In the embodiment of FIG. 1, the center of gravity of the weight member 16 is preferably located at the center of gravity of the exercise member 10. However, the center of gravity of the weight member 16 can be located at a position that is offset from the center of gravity of the exercise member 10. Further, the plane defined by the axis passing through the cross-sectional center of the handle member 12 preferably intersects the center of gravity of the weight member 16.

In the embodiment of FIG. 1, there is only one attachment member 14, which is radial and is attached to the handle member 12 at only one point. Further, the attachment member 14 is relatively small in comparison to the weight member 16. This configuration concentrates the mass at the periphery (the handle member 12) and at the center (the weight member 16) which creates a relatively large space that extends nearly 360° about the weight member 16 where a user can grip without interference with the attachment member 14 or the weight member 14. Thus, the configuration of FIG. 1 makes it relatively easy for a user to pick up the exercise weight 10 and begin use without significant adjustments.

The weight of the handle member 12 is between about five to about ninety-five percent of the weight of the exercise weight 10. Conversely, the weight of the weight member 16 and the attachment member 14 is between about ninety-five to five percent of the weight of the exercise weight 10. That is, the weight ratio of the handle member to the exercise weight is between about five to about ninety-five percent. The ratio of the combination of the weight member 16 and the attachment member 14 to the weight of the exercise weight 10 is between about ninety-five to about five percent.

The ratio of the weight of the weight member 16 to that of the attachment arm 14 can be between about 1:20 and about 20:1, as long as the strength of the attachment arm 14 is not compromised.

In the embodiment of FIG. 1, the exercise weight 10 is a solid, integral, unitary metal casting. However, the exercise weight 10 can be constructed by joining separate components, and the material used for making the exercise weight 10 is not necessarily metal. The exercise weight 10 can be made in various sizes and weights to accommodate the needs of users.

The materials that can be used to make the exercise weight 10 include stainless steel, rubber, rubber-coated metal and rubber-coated resin. The exercise weight 10 can be solid or hollow. The surface finish can be smooth or textured, e.g., ridged or dimpled.

Figure 3:
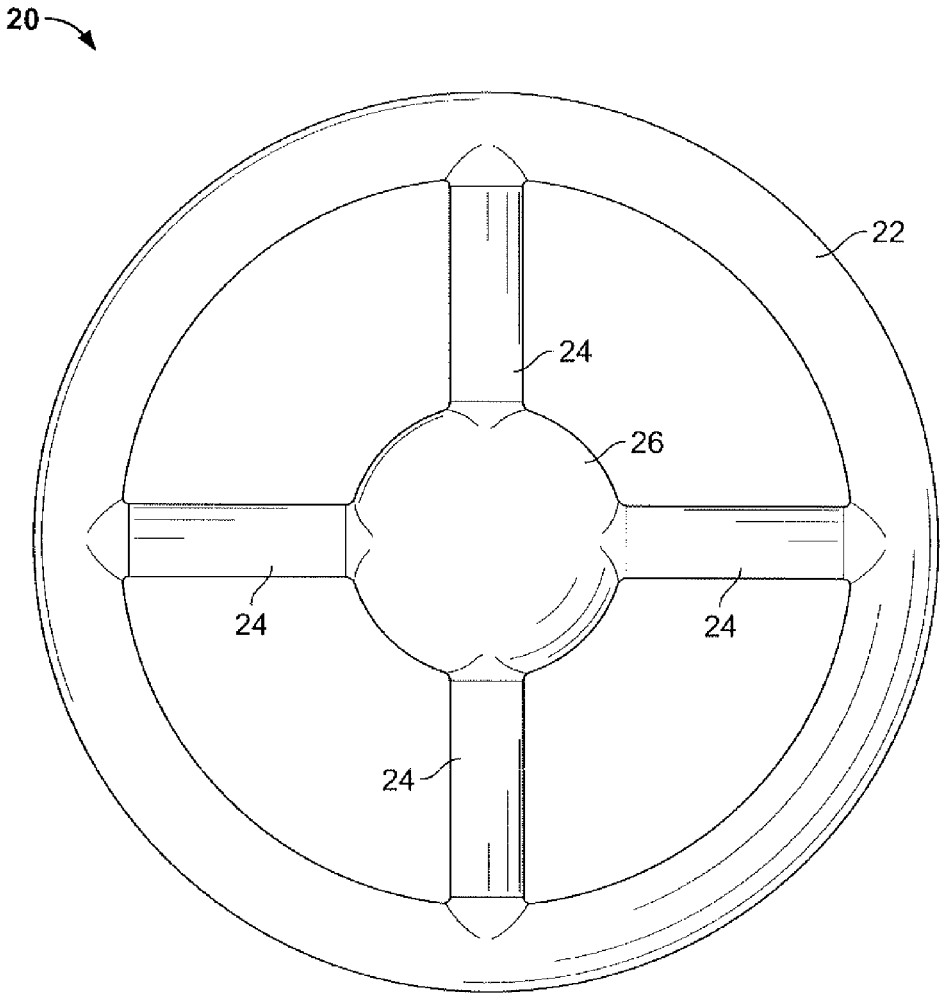
FIG. 3 illustrates a front view of a second embodiment the hand-held exercise weight.

FIG. 3 illustrates a second embodiment in which an exercise weight 20 includes to handle member 22, four attachment members 24, and a weight member 26. The embodiment of FIG. 3 is like that of FIG. 1 except that the embodiment of FIG. 3 has four attachment members 24, which are arranged radially in the plane of the handle member 22. Each of the attachment members 24 is similar to the attachment member 14 of the first embodiment. Although FIG. 3 shows four attachment members, the number of attachment members 24 can be varied and may be two, three, five or more as long as the attachment members 24 do not interfere with the user's ability to grip the handle member 22. Although the attachment members 24 are separated by equal angles in FIG. 3, the angles between the attachment members 24 can be varied.

Figure 4:
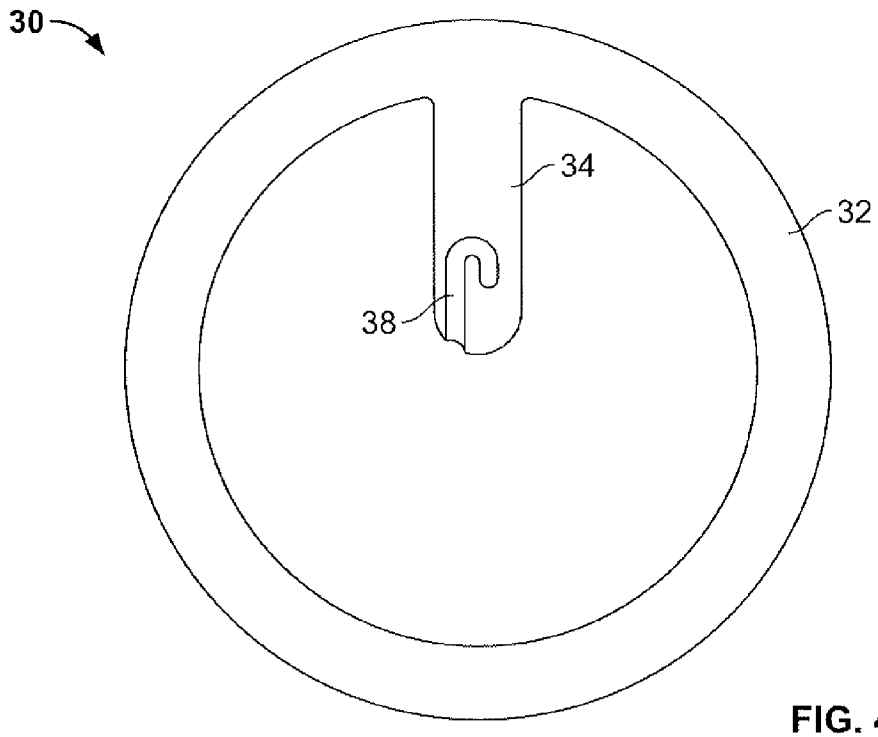
FIG. 4 illustrates a diagrammatic front view of a part of a third embodiment of the invention.
Figure 5:
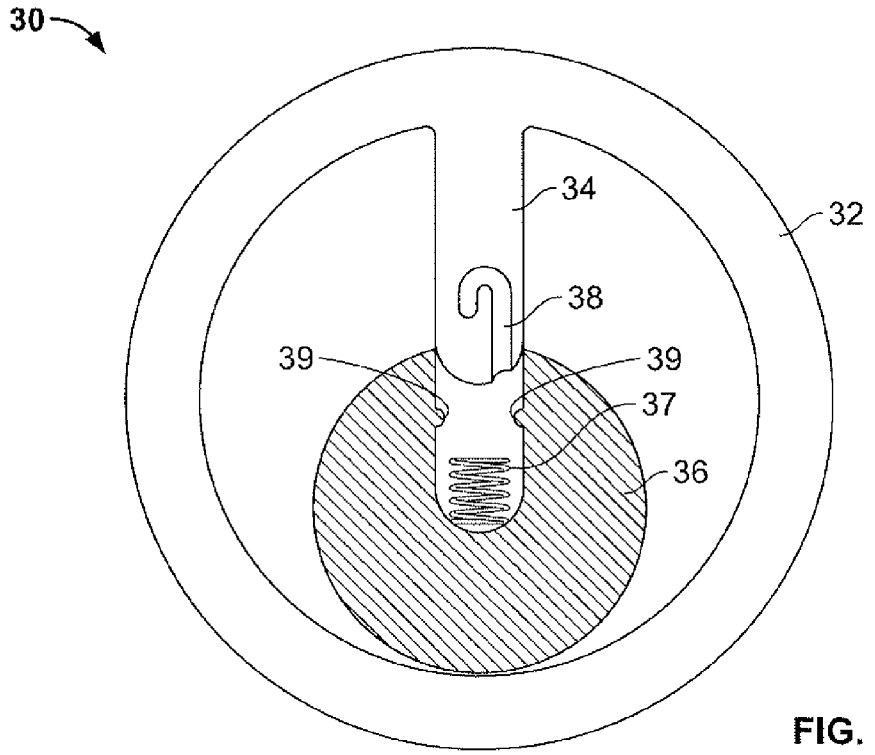
FIG. 5 illustrates a diagrammatic front view, partially in cross-section, of the third embodiment illustrated in FIG. 4, in a state of partial assembly.
Figure 8:
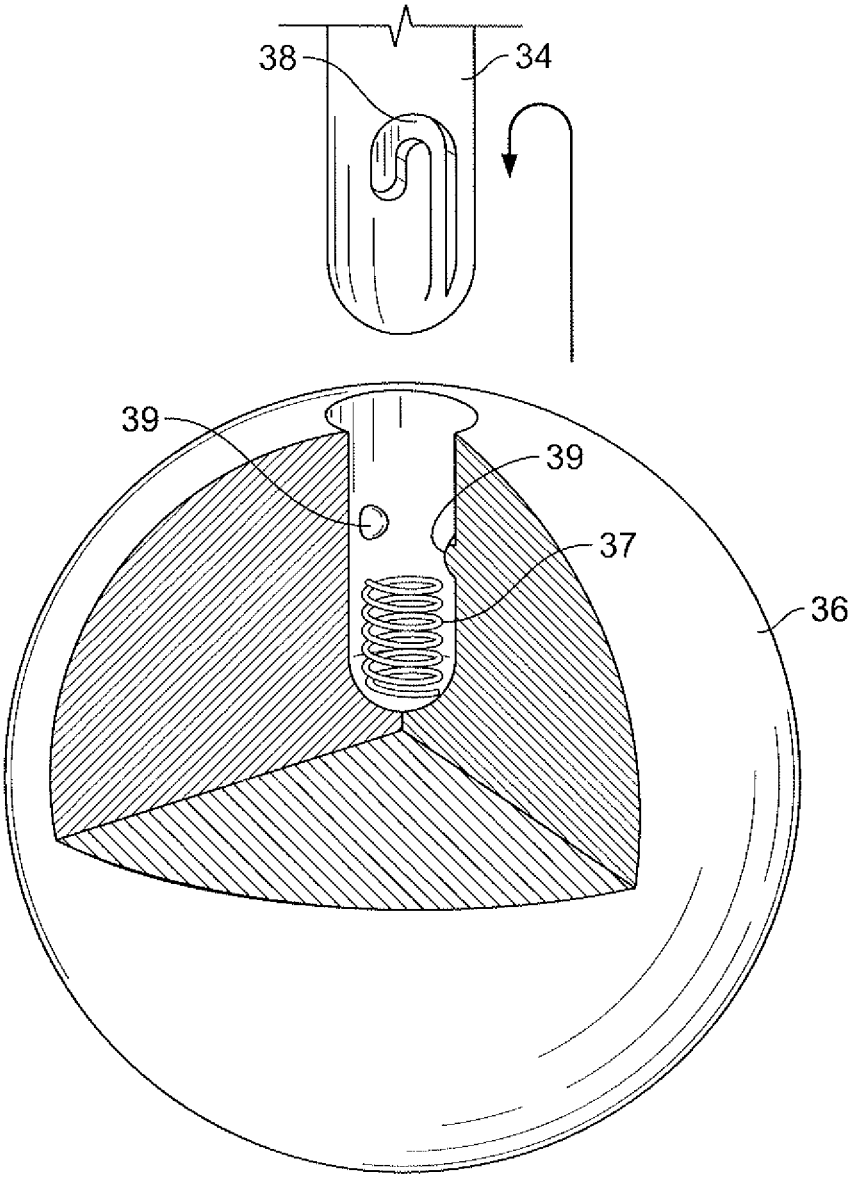
FIG. 8 illustrates a partial perspective view with portions cut-away of the third embodiment illustrated in FIG. 5.

FIGS. 4, 5 and 8 illustrate a third embodiment that includes a handle member 32, an attachment member 34, and a weight member 36. A coupling mechanism 37, 38, 39 connects the weight member 36 to the attachment member 34. Such a coupling mechanism is known as and may be referred to herein as a bayonet coupling. The coupling mechanism includes a spring 37, a pair of curved channels 38 (only one channel 38 is shown) and a pair of protrusions 39, which correspond to the channels 38. The curved channels 38 are located on opposite sides of the attachment member 34.

To couple the weight member 36 to the attachment member 34, the inner end of the attachment member 34 is inserted into a corresponding opening formed in the weight member 36. Then, the weight member 36 is rotated slightly until the protrusions 39 are aligned with the channels 38. Then, the weight member 36 is manually urged toward the handle member 32 against the force of the spring 37. The protrusions 39 follow the channels 38. When the protrusions 39 reach the curved section of the channels 38, the weight member 36 is manually rotated slightly to guide the protrusions along the curvature of the channels 38. The stored energy in the spring 37 then causes the weight member 36 to move away from the handle member 32 until the protrusions 39 settle at the ends of the curved channels 38. The force applied by the spring 37 maintains the protrusions 39 at the ends of the channels 38. The coupling mechanism 37, 38, 39 maintains the weight member 36 on the attachment member 34 until the steps for attaching the weight member 36 are reversed to separate the weight member 36.

Other known coupling mechanisms can be used to couple the weight member 36 to the attachment member 34. For example, the weight member 36 can simply be threaded to the attachment member 34. That is, male threads can be formed on the inner end of the attachment member 34, and female threads can be formed in the opening of the weight member 36 so that the weight member 36 can be threaded to the attachment member 34. Alternatively, the male and female threaded parts can be reversed such that male threads are formed on a member extending from the weight member 36 and female threads are formed in an opening formed in the attachment member. Similarly, such threaded engagement may be used to join the attachment member 34 to the handle member.

In a modification of the embodiment of FIG. 5, a combination of the weight member 36 and the attachment member 34 can be coupled to the handle member 32 with a coupling mechanism. That is, a coupling mechanism can be located between the attachment member and the handle member 32.

Figure 6:
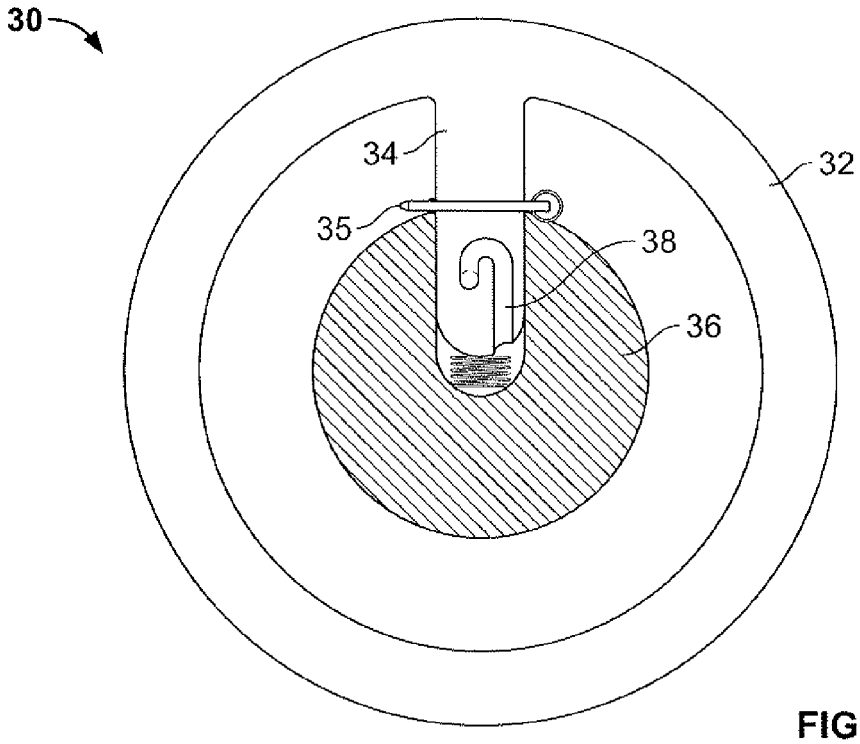
FIG. 6 illustrates a diagrammatic front view, partially in cross-section, of a fourth embodiment of the invention.

In addition, various locking devices can be employed to secure the weight member 16 to the attachment member 34. For example, FIG. 6 illustrates a fourth embodiment in which a pin 35 is used to secure the weight member 36 to the attachment member 34. The embodiment of FIG. 6 is the same as that of FIGS. 4, 5, and 8, except for the addition of the pin 35. A hole (unnumbered) is formed in the attachment member 34 at a location where the outside of the weight member 36 meets the surface of the attachment member 34 when the weight member 36 is coupled to the attachment member 34. When the weight member 36 is coupled to the attachment member 34, the pin 35 is fitted into the hole to prevent accidental separation of the weight member 36 from the attachment member 34. That is, the pin prevents the weight member 36 from moving toward the handle member 32, which prevents the protrusions 39 from entering the curved part of the channels 38. This prevents separation of the weight member 36 from the attachment member 34.

Figure 7:
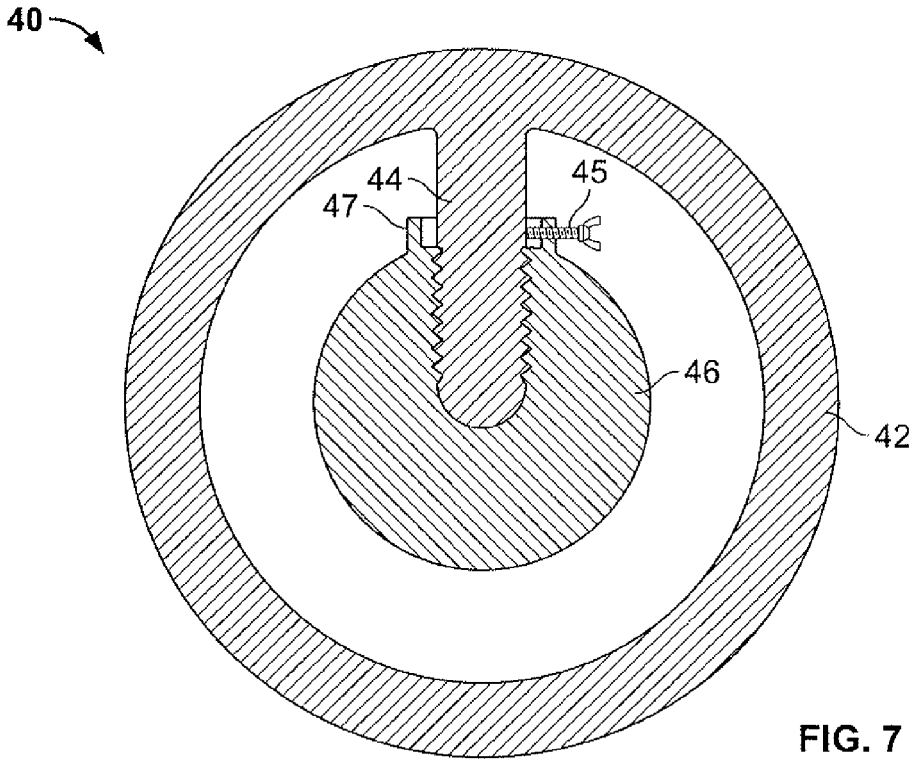
FIG. 7 illustrates a diagrammatic cross-sectional view of a fifth embodiment of the invention.

FIG. 7 illustrates a fifth embodiment, which includes a handle member 42, an attachment member 44, a weight member 46, and a locking screw 45. In this embodiment, threads are formed on both the weight member 46 and the attachment member 44 so that the weight member 46 can be threaded to the attachment member 44. A collar 47 is formed integrally on the weight member 46. A threaded hole is formed in the collar 47, and the threaded locking screw 45 is threaded into the hole so that an end of the locking screw 45 engages the surface of the attachment member 44 when the locking screw 45 is tightened. When the locking screw 45 is firmly engaged with the attachment member 44, the weight member 46 cannot be rotated about the axis of the attachment member 44; therefore, the weight member 46 cannot be removed from the attachment member 44.

FIG. 7 illustrates one of many possible locking devices for preventing accidental separation of the weight member 46 from the attachment member 44. The locking mechanism of FIG. 7 can also be employed in the embodiment of FIG. 5 to prevent the weight member 36 from accidentally separating from the attachment member 34.

Alternatively, in FIG. 7 the collar 47 need not be provided and a threaded hole can be formed through the weight member 46 so that the locking screw can engage a threaded part of the attachment member 44 to lock the weight member 46 in place. In a further alternative, a threaded collar, or locking ring, can be threaded on the attachment member 44 prior to threading the weight member 46 onto the same threads of the attachment member 44. To lock the weight member 46, the threaded collar is hand-tightened against the weight member 46.

Figure 9:
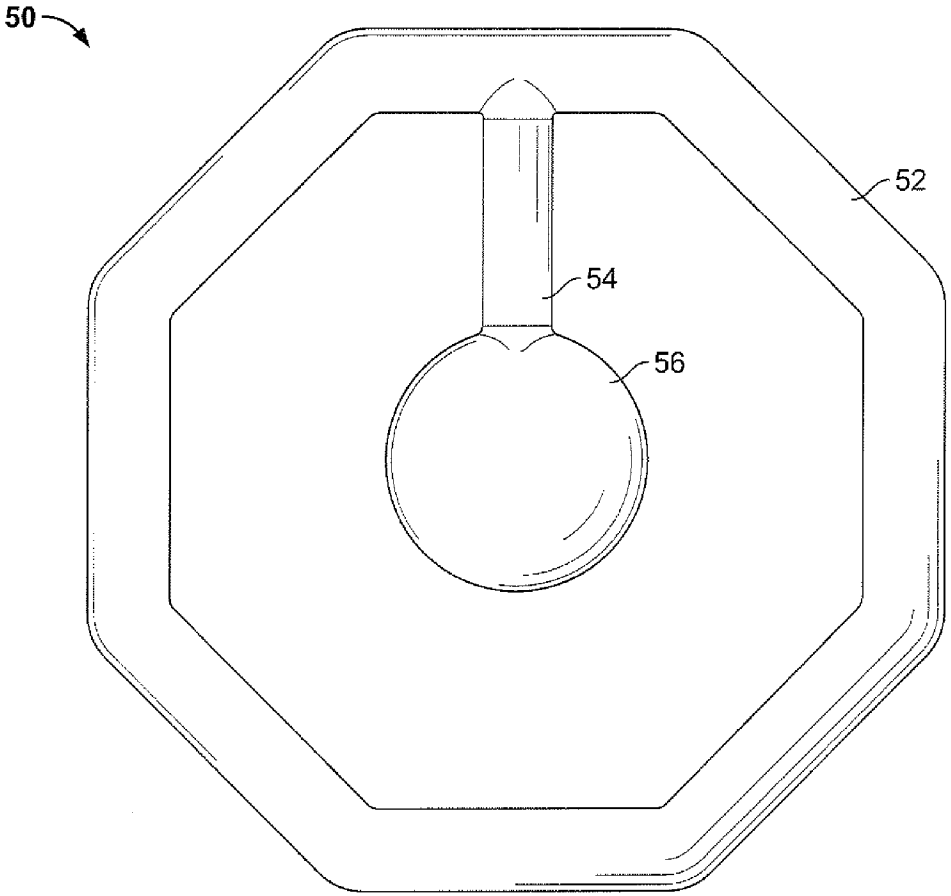
FIG. 9 illustrates a front view of a sixth embodiment of the invention.

FIG. 9 illustrates an exercise weight 50 of a sixth embodiment. The exercise weight 50 includes a handle 52, an attachment member 54, and a weight member 56. As shown, the handle member 52 is polygonal. Specifically, the handle member 52 forms a hexagon. However, the number of sides of the polygonal handle member 52 can vary. Like the first embodiment, the axis of the handle member 52 preferably lies in a plane, and the axis of the attachment member 54 preferably lies in the plane defined by the axis of the handle member 52.

Figure 10:
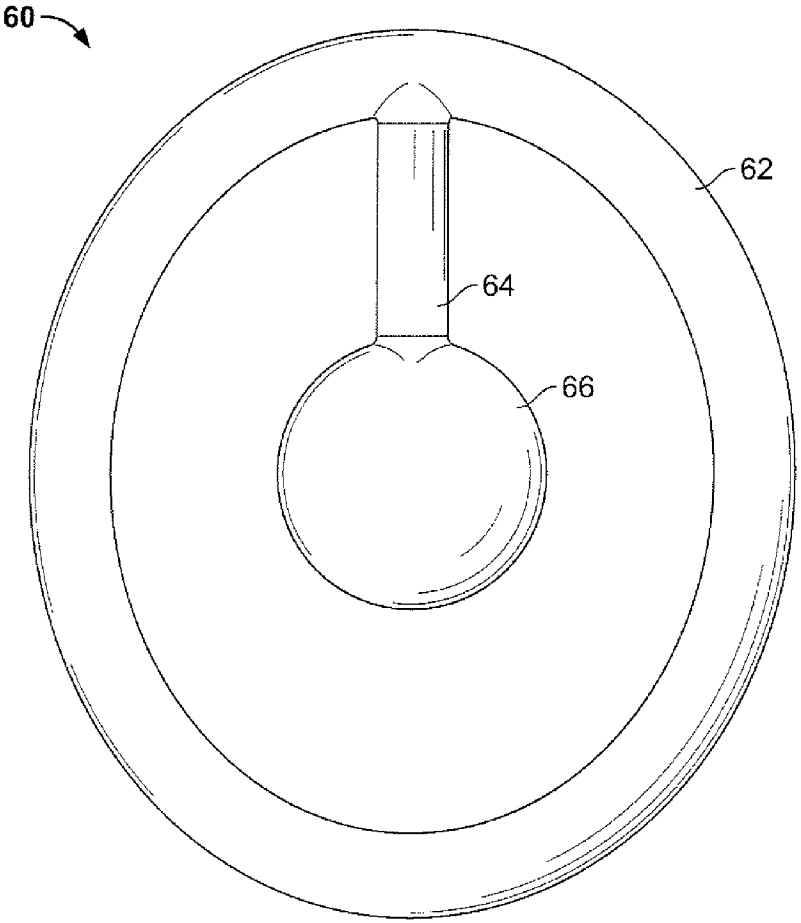
FIG. 10 illustrates a front view of a seventh embodiment of the invention.

FIG. 10 illustrates a seventh embodiment in which an exercise weight 60 includes a handle member 62, an attachment member 64 and a weight member 66. The embodiment of FIG. 10 is the same as that of FIG. 1, except that the handle member 62 is elliptical, or oval, and the axis of the attachment member extends along the major axis of the ellipse formed by the handle member 62. The axis of the attachment member can also be located to extend along the minor axis of the handle member 62, for example.

Figure 11:
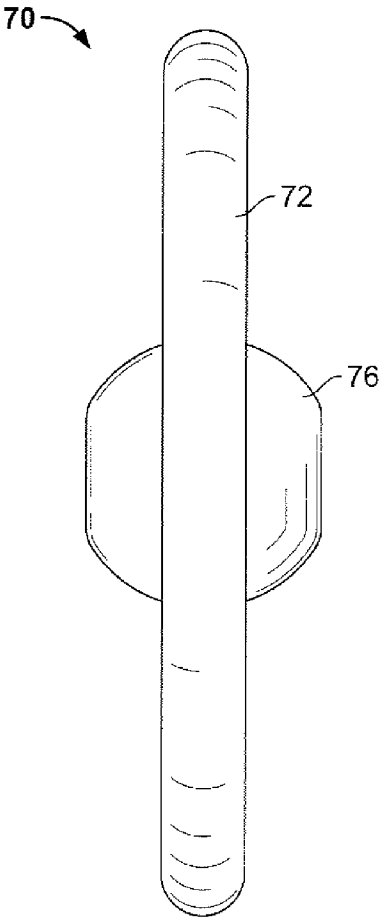
FIG. 11 illustrates a side view of an eighth embodiment of the invention.

FIG. 11 illustrates an eighth embodiment in which an exercise weight 70 includes a handle member 72, and a weight member 76. The embodiment of FIG. 11 has an attachment member that is hidden from view. The embodiment of FIG. 11 is the same as that of FIG. 1, except that the weight member 76 is flattened on opposite sides. In other words, the weight member 76 has the shape of a flattened sphere. The flattened weight member 76 reduces the width, or profile, of the exercise weight 70 and facilitates stacking of a plurality of exercise weights 70. The flattening can be any degree of flattening, so that, for example, the ratio of thickness to diameter of the weight member ranges from about 5% to about 99%

Figure 12:
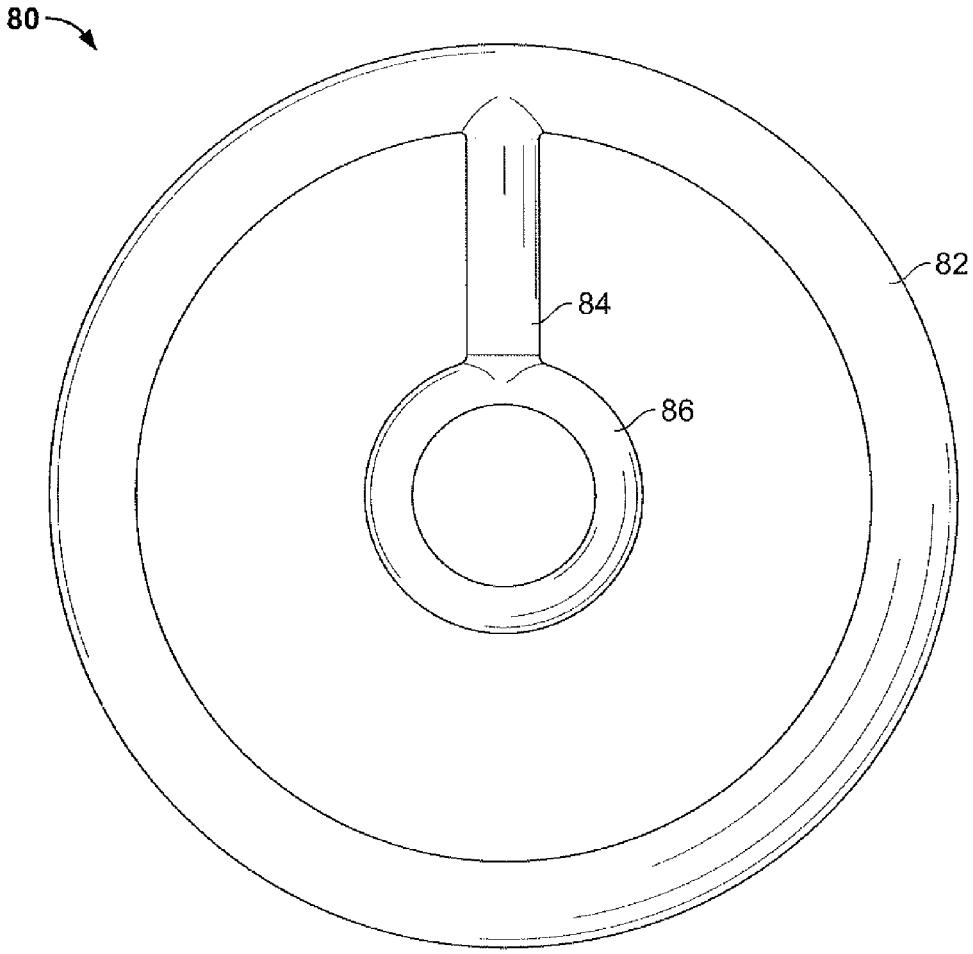
FIG. 12 illustrates a front view of a ninth embodiment of the invention.

FIG. 12 illustrates a ninth embodiment in which an exercise weight 80 includes a handle member 82, an attachment member 84, and weight member 86. The embodiment of FIG. 12 is the same as that of FIG. 1, except that the weight member 86 is annular, like the handle member 82. That is, the weight member 86 has the shape of a torus. The weight member 86 is approximately concentric with the handle member 82 in this embodiment. The size of the weight member 86 can be larger than that illustrated if additional weight is desired, as long as sufficient space is available for a person's fingers to grip the handle without interference with the weight member 86. This embodiment has a relatively narrow width, or profile (as measured perpendicular to the plane of FIG. 12), in comparison to the embodiment of FIG. 1.

Figure 13:
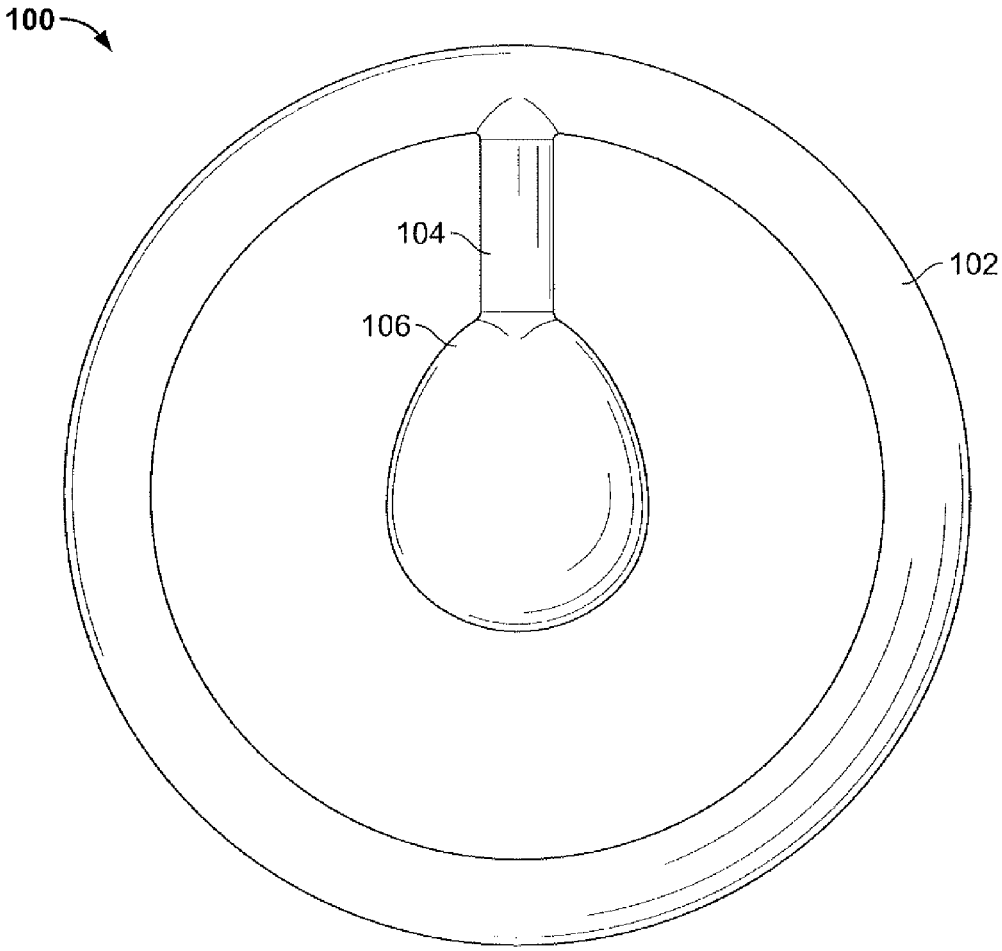
FIG. 13 illustrates a front view of a tenth embodiment of the invention.

FIG. 13 illustrates a tenth embodiment in which an exercise weight 100 includes a handle member 102, an attachment member 104, and a weight member 106. The embodiment of FIG. 13 is the same as that of FIG. 1, except that the weight member 106 is ovoid. In other words, the weight member 106 has a globular shape in which a distal end of the weight member 106 is slightly larger than a proximal end, which is attached to the inner end of the attachment member 104. In this embodiment, the axis of the weight member 106 is coextensive with the axis of the attachment member 104. In a modification of this embodiment, the weight member 106 can be flattened like the weight member 76 of FIG. 11.

Figure 14:
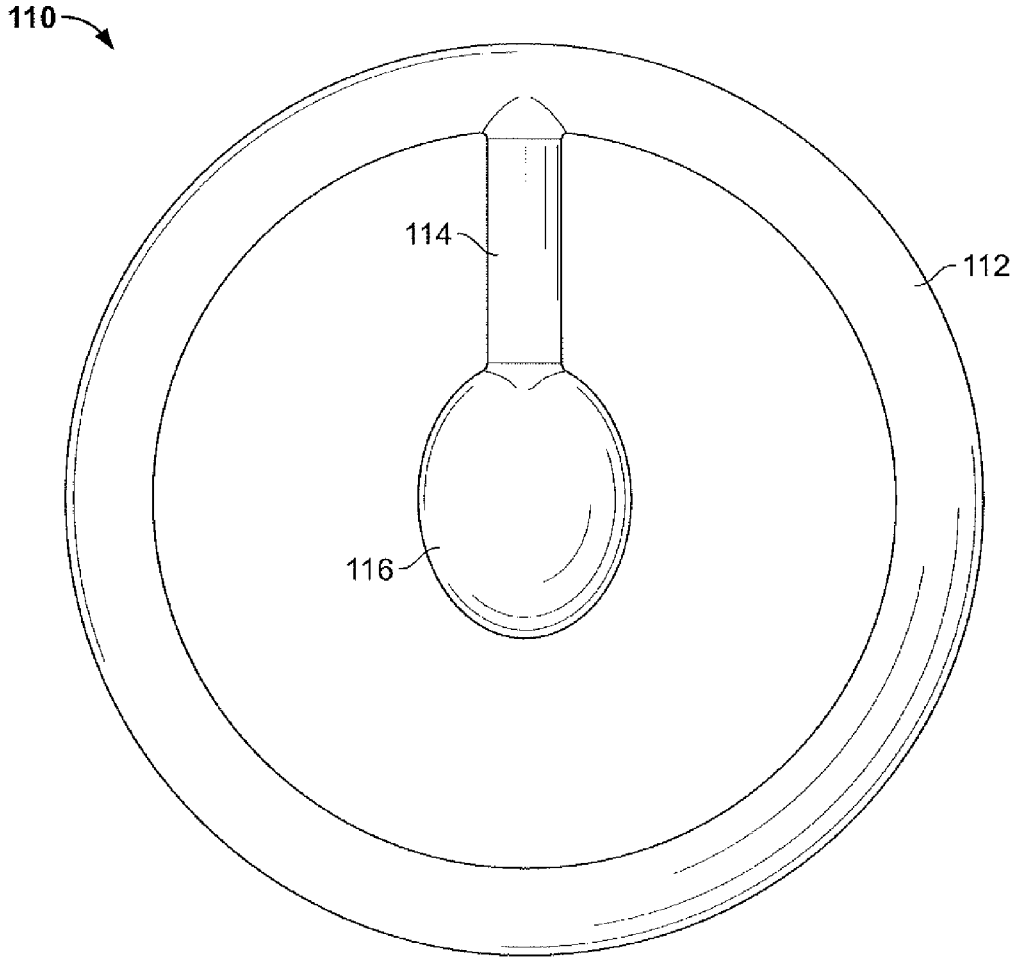
FIG. 14 illustrates a front view of an eleventh embodiment of the invention.

FIG. 14 illustrates an eleventh embodiment in which an exercise weight 110 includes a handle member 112, an attachment member 114, and a weight member 116. The embodiment of FIG. 14 is the same as that of FIG. 1, except that the weight member 116 is generally an elliptical or oval sphere. In this embodiment, the longitudinal axis of the weight member 116 is coextensive with the axis of the attachment member 114. In a modification of this embodiment, the weight member 116 can be flattened like the weight member 76 of FIG. 11.

Figure 15:
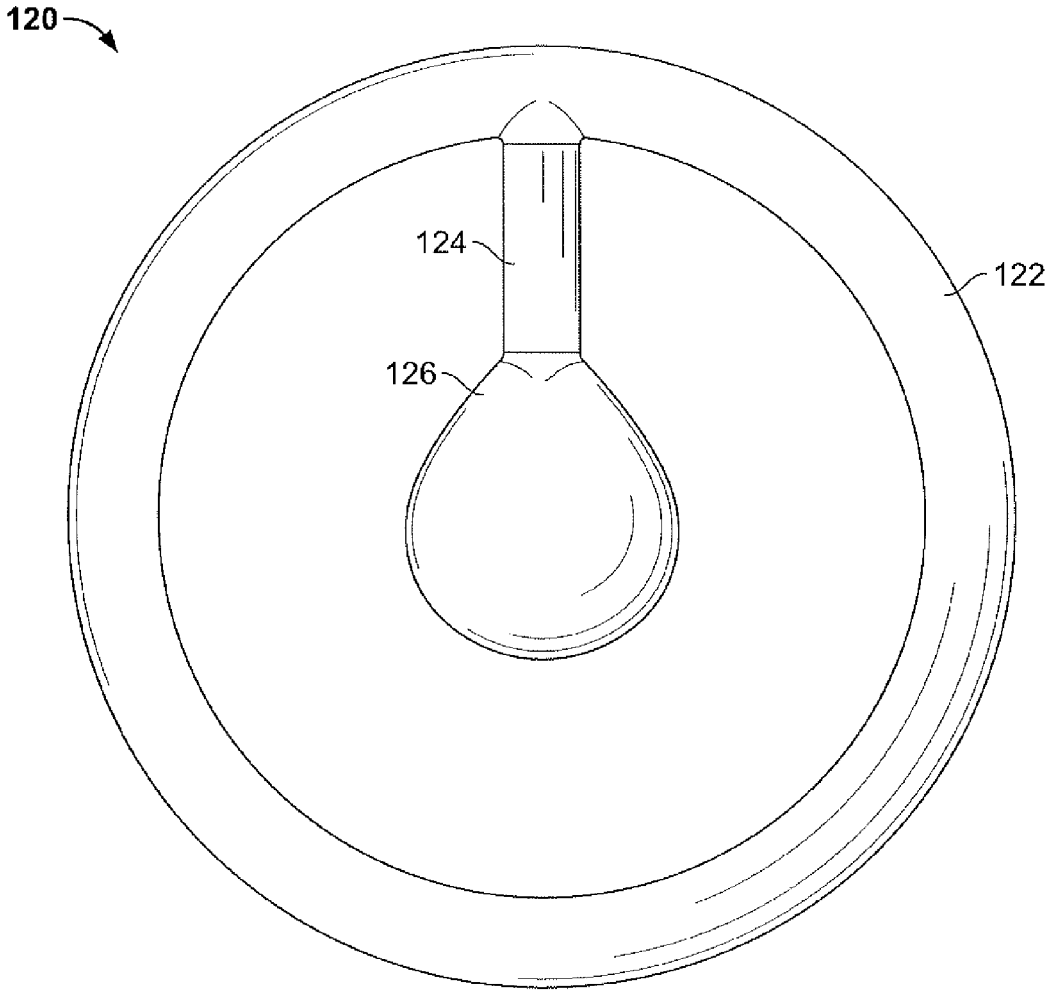
FIG. 15 illustrates a front view of a twelfth embodiment of the invention.

FIG. 15 illustrates a twelfth embodiment in which an exercise weight 120 includes a handle member 122, an attachment member 124, and a weight member 126. The embodiment of FIG. 15 is the same as that of FIG. 1, except that the weight member 126 is generally spherical and teardrop shaped. In other words, the weight member 126 has an aerodynamic shape in which a distal end of the weight member 126 is slightly larger than a proximal end of the weight member 126, and the longitudinal axis of the weight member 126 is coextensive with the axis of the attachment member 124. In a modification of this embodiment, the weight member 126 can be flattened like the weight member 76 of FIG. 11.

Figure 16:
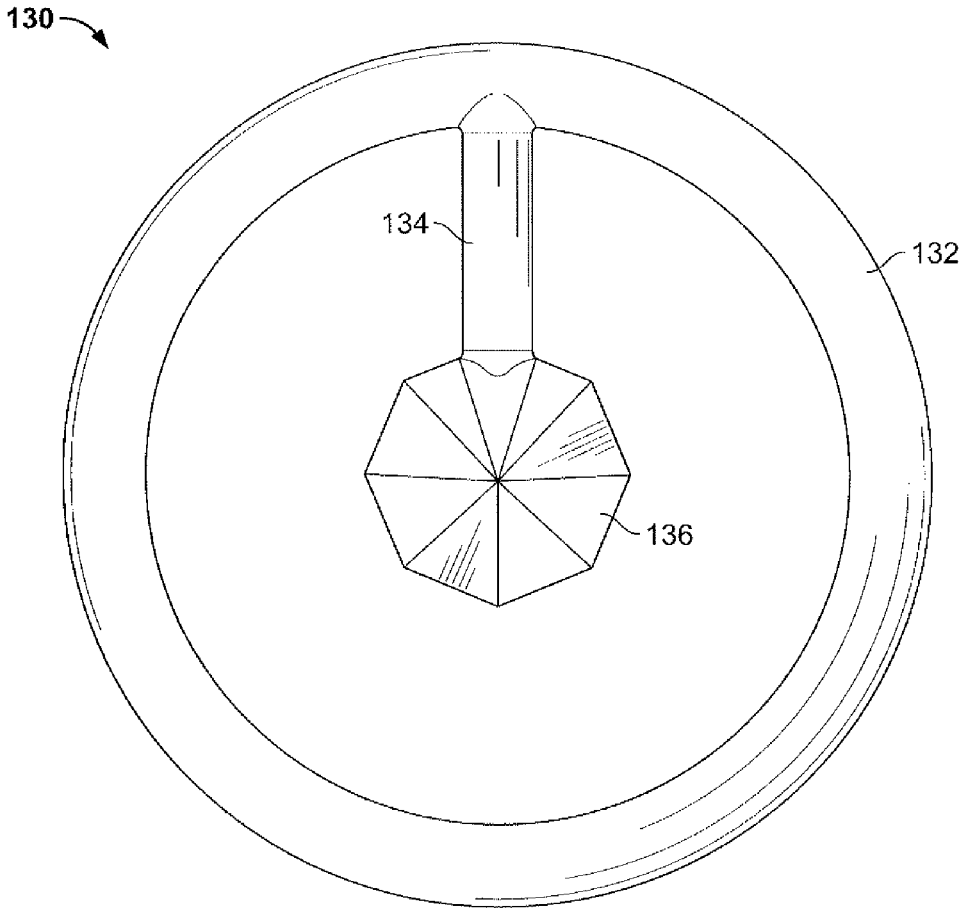
FIG. 16 illustrates a from view of a thirteenth embodiment of the invention.

FIG. 16 illustrates a thirteenth embodiment in which an exercise weight 130 includes a handle member 132, an attachment member 134, and a weight member 136. The embodiment of FIG. 16 is the same as that of FIG. 1, except that the weight member 136 has the shape of a multifaceted three-dimensional solid. The shape of the weight member can be polyhedral, in which the faces are the same, or the faces can differ from one another. Although the faces are triangular in FIG. 16, the faces can be pentagonal, hexagonal or octagonal, for example. As in the previous embodiments, the center of the weight member 136 preferably coincides with the center of gravity of the exercise weight 130, which is approximately the center of the handle member 132.

Figure 17:
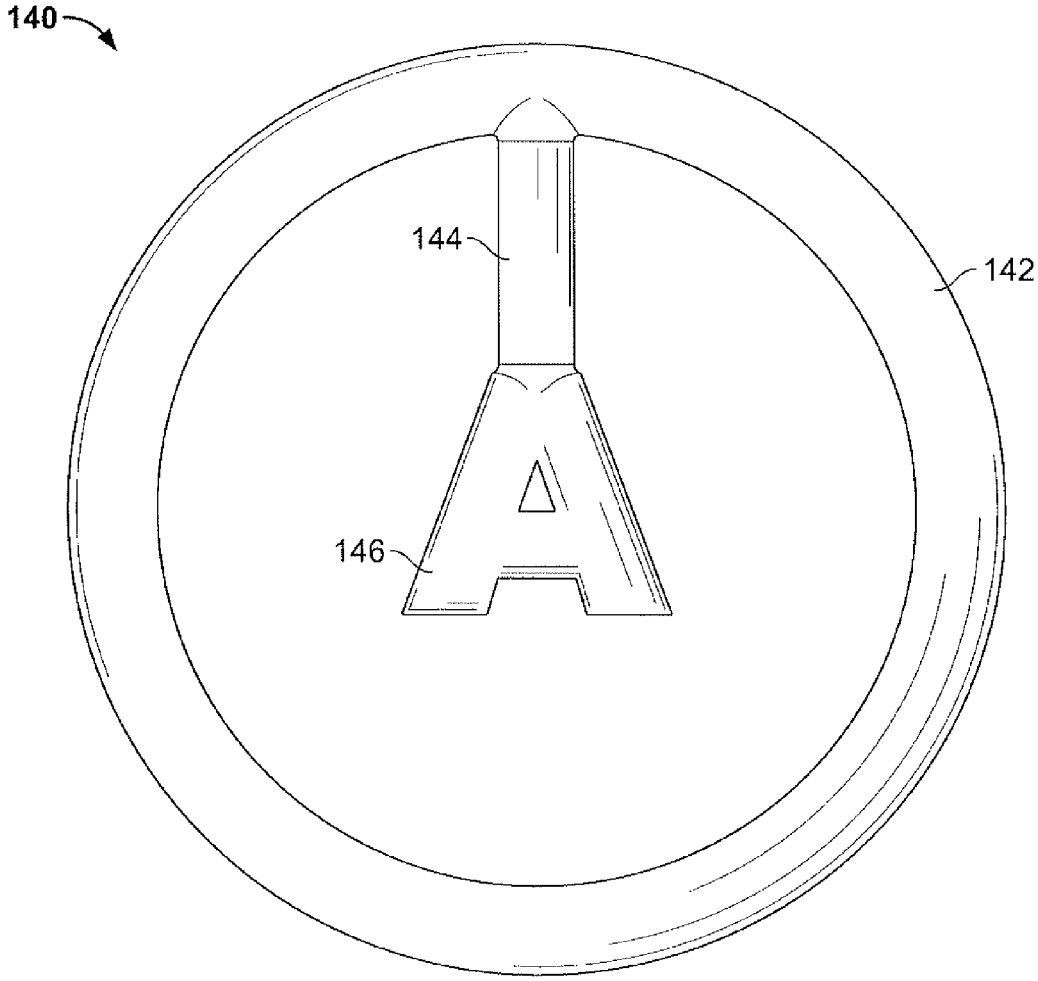
FIG. 17 illustrates a front view of a fourteenth embodiment of the invention.

FIG. 17 illustrates a fourteenth embodiment in which an exercise weight 140 includes a handle member 142, an attachment member 144, and a weight member 146. The embodiment of FIG. 17 is the same as that of FIG. 1, except that the weight member 146 has the form of a letter. In this embodiment, the letter is "A," however, the letter can be any letter.

Figure 18:
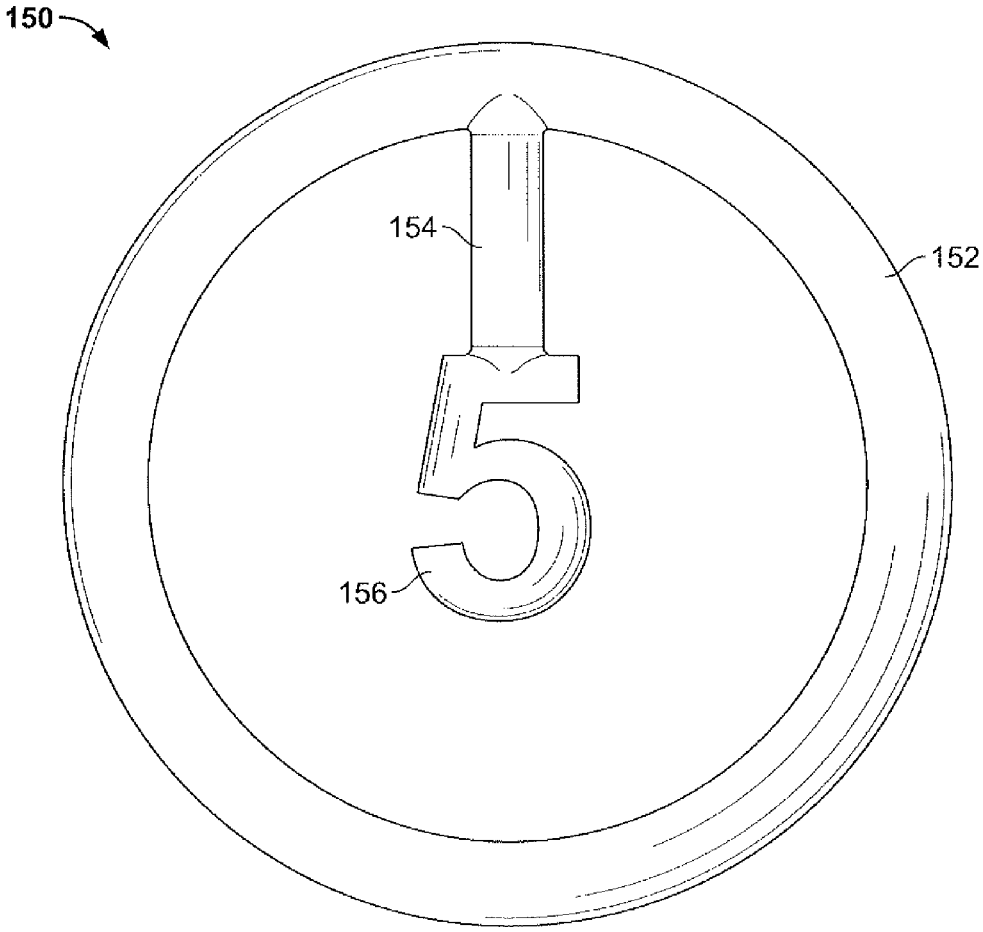
FIG. 18 illustrates a front view of a fifteenth embodiment of the invention.

FIG. 18 illustrates a fifteenth embodiment in which an exercise weight 150 includes a handle member 152, an attachment member 154, and a weight member 156. The embodiment of FIG. 18 is the same as that of FIG. 1, except that the weight member 156 has the form of a number. In this embodiment, the number is "5." However, the number can be any number.

Figure 19:
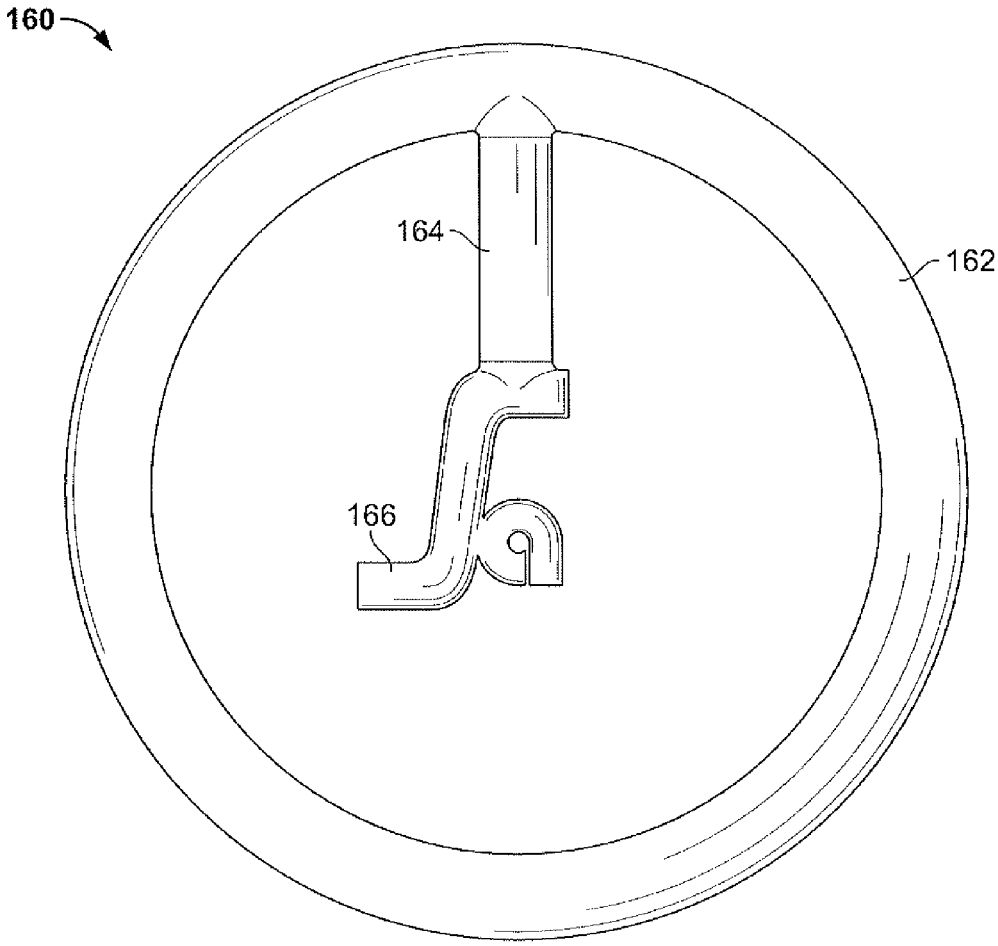
FIG. 19 illustrates a front view of a sixteenth embodiment of the invention.

FIG. 19 illustrates a sixteenth embodiment in which an exercise weight 160 includes a handle member 162, an attachment member 164, and a weight member 166. The embodiment of FIG. 19 is the same as that of FIG. 1, except that the weight member 166 has the form of an emblem, symbol, design or mark. The emblem, symbol or mark is arbitrarily selected and can have any shape as long as there is adequate clearance between the weight member 166 and the handle member 162 to permit a person's hand to grip the handle member 162 without interference by the weight member 166.

Figure 20:
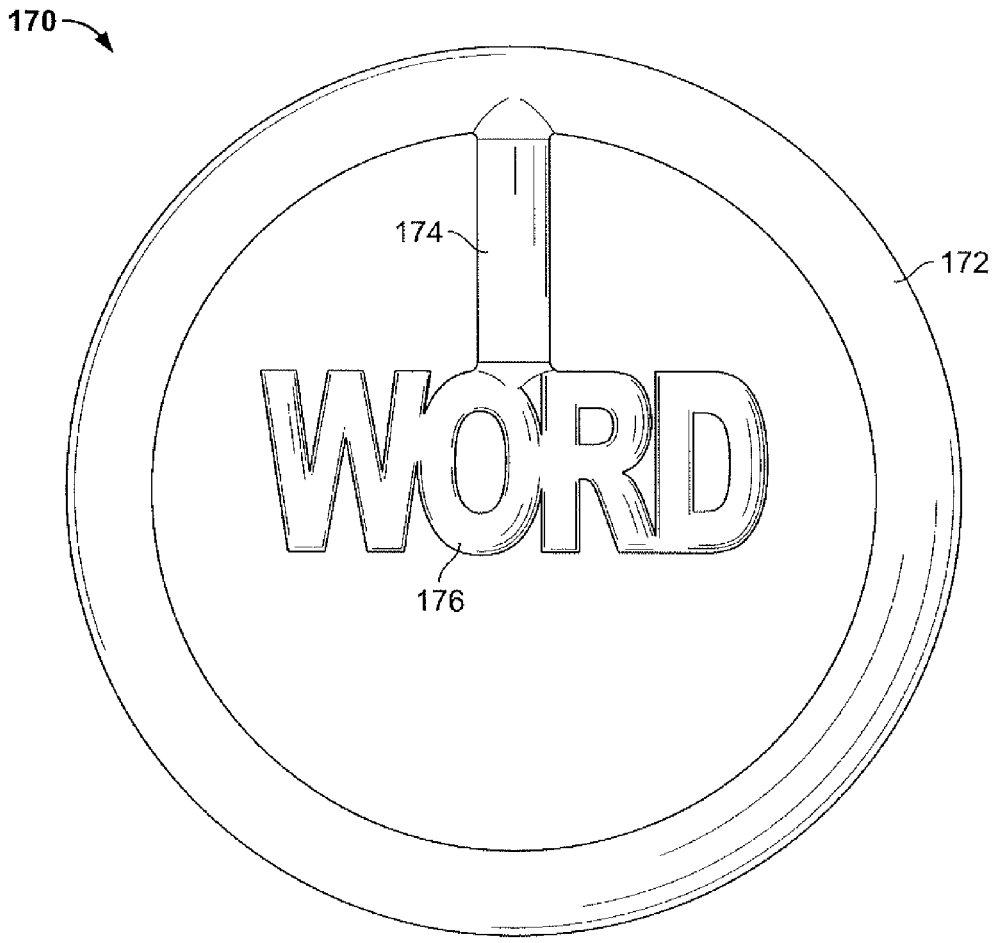
FIG. 20 illustrates a front view of a seventeenth embodiment of the invention.

FIG. 20 illustrates a seventeenth embodiment in which an exercise weight 170 includes a handle member 172 an attachment member 174, and a weight member 176. The embodiment of FIG. 20 is the same as that of FIG. 1, except that the weight member 166 has the form of a word. The word arbitrarily selected and can be any word as long as there is adequate clearance between the weight member 166 and the handle member 172 to permit a person's hand to grip the handle member 172 without interference by the weight member 176.

Figure 21:
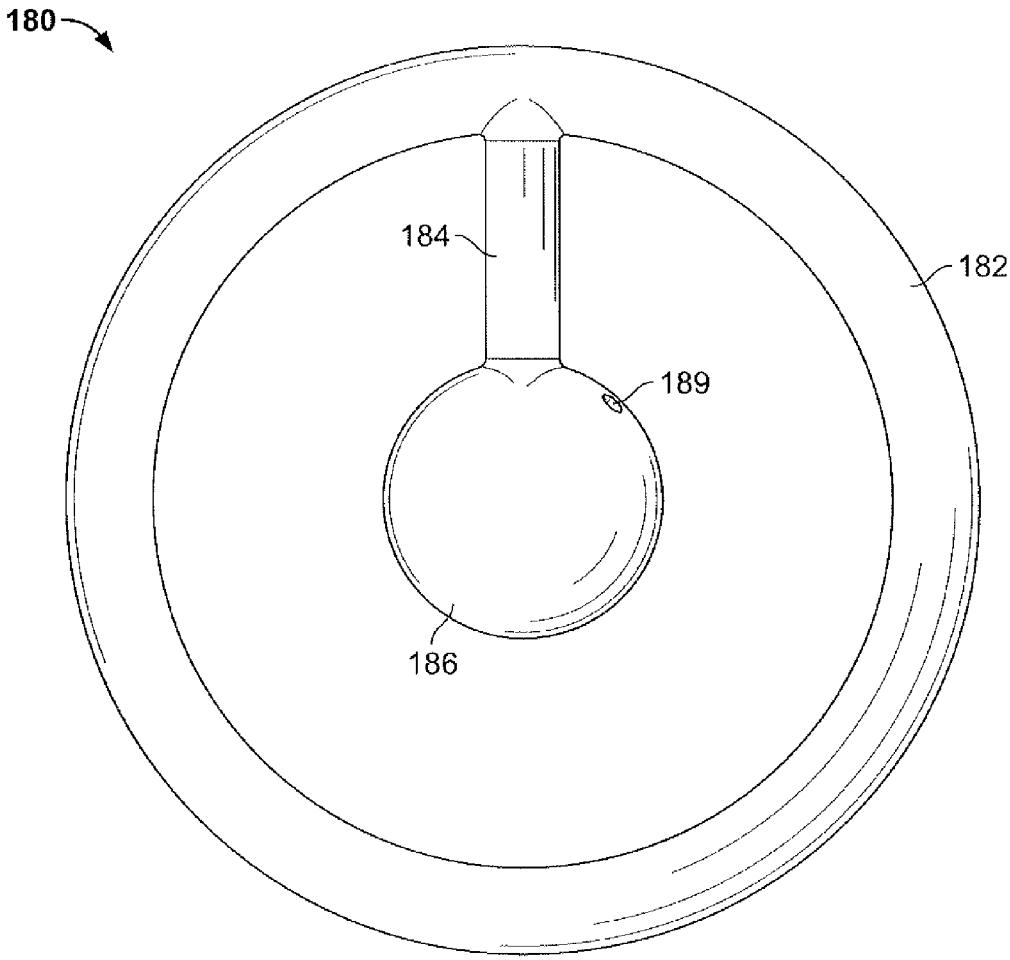
FIG. 21 illustrates a front view of an eighteenth embodiment of the invention.
Figure 23:
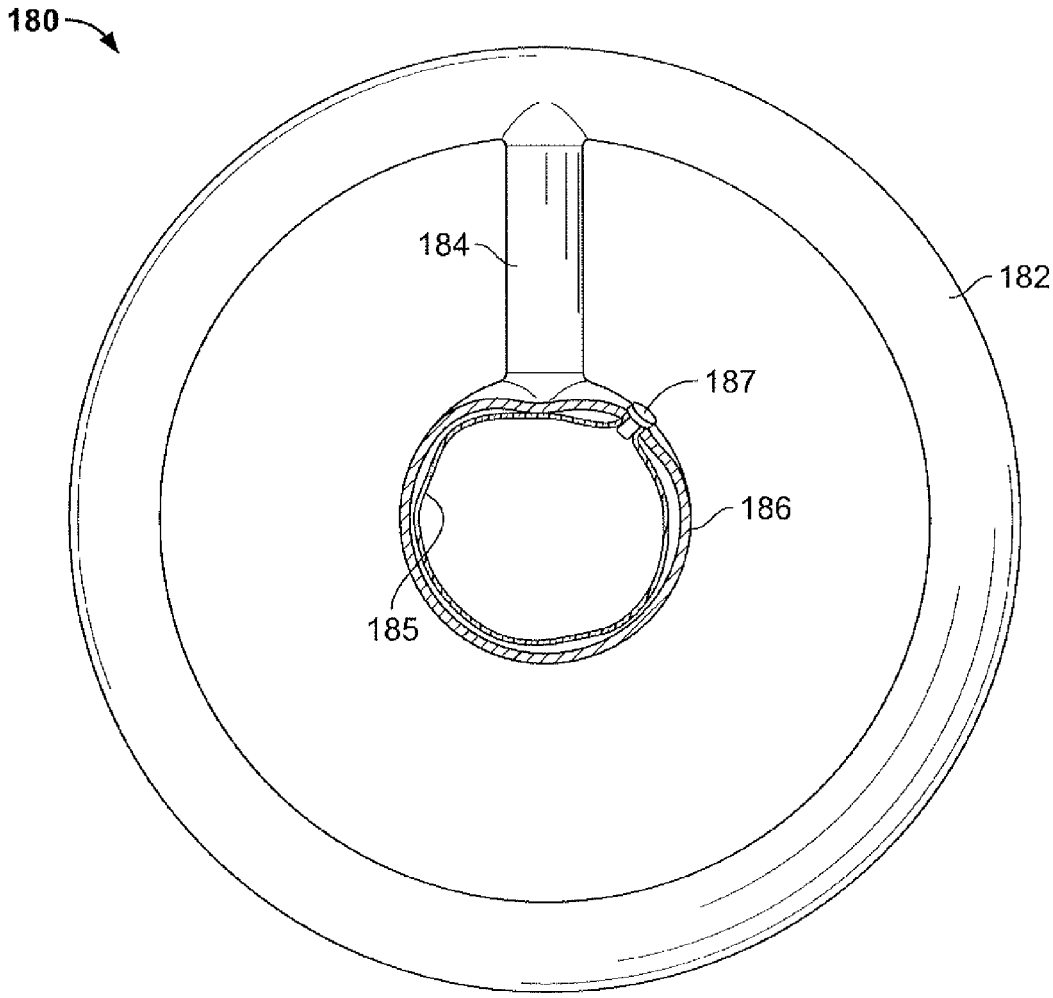
FIG. 23 illustrates a front view, partially in cross-section, of the eighteenth embodiment of the invention.

FIGS. 21 and 23 illustrate an eighteenth embodiment in which an exercise weight 180 includes a handle member 182, an attachment member 184, and a weight member 186. The embodiment of FIG. 21 is the same as that of FIG. 1, except that the weight member 186 includes a space for containing fluid. That is, the weight member 186 includes a cavity, and an opening 189 is formed in the weight member 186 to provide access to the cavity. Fluid can be added to or removed from the weight member 186 through the opening 189 to add weight to or remove weight from the exercise weight 180. The ability to add and remove fluid makes the exercise weight 180 more portable, since the exercise weight 180 is lighter and easier to transport when empty.

An insert or bladder 185 can be provided within the cavity. In other words, the space for containing fluid can be a space within the bladder 185. The bladder 185 can be rigid or flexible. The bladder 185 contains the fluid within the cavity of the weight member 186 so that the fluid, does not directly contact the wall of the weight member 186.

After fluid is placed in the hollow weight member 186 or the bladder 185, a stopper 187 is fitted in the opening 189 to prevent the fluid from escaping. The stopper 187 is removable to permit the fluid to be removed from the weight member 186. Although the stopper 187 is simple plug in the embodiment of FIG. 23, a threaded neck can be provided on the bladder 185 or the weight member 186, and a threaded cap can be used to close the opening 189.

Figure 22:
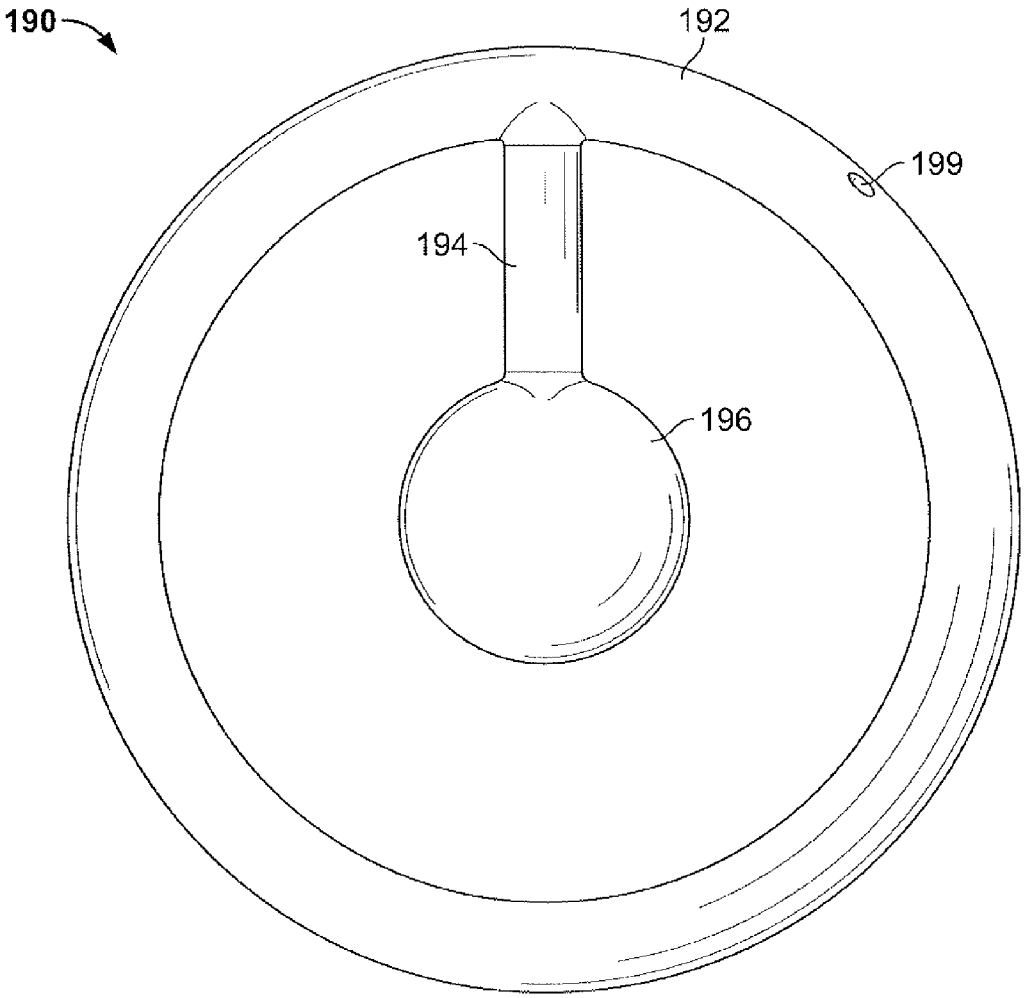
FIG. 22 illustrates a front view of a nineteenth embodiment of the invention.

FIG. 22 illustrates a nineteenth embodiment in which an exercise weight 190 includes a handle member 192, an attachment member 194, and a weight member 196. The embodiment of FIG. 22 is the same as that of FIG. 1, except that the handle member 192 is hollow and can be filled with fluid to add weight to the exercise weight 190. An opening 199 is formed in the handle member 192 to permit fluid to be added and removed. Although not illustrated, a stopper like that illustrated in FIG. 23 is used to seal the opening 199.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to use the invention in various embodiments and with various modifications as suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

The invention claimed is:

1. An exercise weight, comprising:

a weight member;

a handle member spaced apart from and substantially surrounding the weight member;

a grip space is defined between the handle member and the weight member, the grip space extends about substantially an entirety of the weight member, so that the weight member does not interfere with a fingers' grip of the handle member in the grip space; and at least one attachment member joining the weight member to the handle member, wherein the weight member includes a space for containing a fluid and an opening for adding or removing the fluid.

2. An exercise weight, comprising:

a weight member;

a handle member spaced apart from and substantially surrounding the weight member;

a grip space is defined between the handle member and the weight member, the grip space extends about substantially an entirety of the weight member, so that the weight member does not interfere with a fingers' grip of the handle member in the grip space;

at least one attachment member joining the weight member to the handle member; and a coupling mechanism that is located between the attachment member and the weight member or between the attachment member and the handle member.

3. An exercise weight, comprising:

a weight member;

a handle member spaced apart from and substantially surrounding the weight member;

a grip space is defined between the handle member and the weight member, the grip space extends about substantially an entirety of the weight member, so that the weight member does not interfere with a fingers' grip of the handle member in the grip space; and at least one attachment member joining the weight member to the handle member, wherein a coupling mechanism includes one of a threaded engagement and a bayonet coupling between the attachment member and the weight member.

4. The exercise weight according to claim 3, wherein the exercise weight includes a locking device for locking the weight member to the attachment member.

5. The exercise weight according to claim 2, wherein the handle member is annular.

6. The exercise weight according to claim 2, wherein the weight member includes a space for containing a fluid and an opening for adding or removing the fluid.

* * * * *